US006285151B1

(12) United States Patent
Wright et al.

(10) Patent No.: US 6,285,151 B1
(45) **Date of Patent: *Sep. 4, 2001**

(54) METHOD OF COMPENSATION FOR FLUX CONTROL OF AN ELECTROMECHANICAL ACTUATOR

(75) Inventors: Danny Orlen Wright, Cobbs Creek; Perry Robert Czimmek, Williamsburg, both of VA (US)

(73) Assignee: Siemens Automotive Corporation, Auburn Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,513

(22) Filed: Nov. 5, 1999

Related U.S. Application Data

(60) Provisional application No. 60/107,397, filed on Nov. 6, 1998.

(51) Int. Cl.[7] ..... H01H 9/00; H01H 47/28

(52) U.S. Cl. ..... 318/560; 318/129; 318/135; 318/139; 361/156; 361/167; 361/187; 123/90.11

(58) Field of Search ..... 318/139, 560, 318/129, 135, 561–699; 361/167, 210, 154, 160, 159, 170, 199, 187; 123/90.11, 490, 90.12; 335/256, 266; 251/129.01

(56) References Cited

U.S. PATENT DOCUMENTS

| | | | | |
|---|---|---|---|---|
| 5,748,433 | * | 5/1998 | Schrey et al. | 361/210 |
| 5,775,276 | * | 7/1998 | Yanai et al. | 123/90.11 |
| 5,991,143 | * | 11/1999 | Wright et al. | 361/187 |
| 6,024,060 | * | 2/2000 | Buehrle, II et al. | 123/90.12 |
| 6,128,175 | * | 10/2000 | Wright et al. | 361/154 |

FOREIGN PATENT DOCUMENTS

| | | | |
|---|---|---|---|
| 0 810 350 A1 | 12/1997 | (EP) . | |
| 09320841 | 3/1998 | (JP) | H01F/7/18 |

OTHER PUBLICATIONS

PCT International Search Report, International Application No. PCT/US 99/26051, International Filing date: Nov. 5, 1999 and Priority Date: Nov. 6, 1998.

* cited by examiner

*Primary Examiner*—Paul Ip

(57) ABSTRACT

A method of controlling velocity of an armature of an electromagnetic actuator as the armature moves from a first position towards a second position is provided. The electromagnetic actuator includes a coil and a core at the second position. The coil generates a magnetic force to cause the armature to move towards and land at the second position. A control method is provided to ensure a near zero velocity landing of the armature in the second position while compensating for non-ideal external influences on the system.

12 Claims, 7 Drawing Sheets

GAMMA TIME COMPENSATION

METHOD OF COMPENSATION FOR FLUX CONTROL OF AN ELECTROMECHANICAL ACTUATOR

This application claims the benefit of U.S. Provisional Application No. 60/107,397 filed Nov. 6, 1998, which is hereby incorporated by reference in its entirety.

FIELD OF THE INVENTION

This invention relates to a high-speed, high-force electromagnetic actuator and particularly to an electromagnetic actuator and method for opening and closing a valve of an internal combustion engine. More particularly, this invention relates to a electromagnetic actuator and method wherein the velocity of the armature is dynamically controlled upon landing against the stator core of the actuator.

BACKGROUND OF THE INVENTION

An electromagnetic actuator for opening and closing a valve of an internal combustion engine generally includes an electromagnet for producing an electromagnetic force on an armature. The armature is neutrally-biased by opposing first and second return springs and coaxially coupled with a cylinder valve stem of the engine. In operation, the armature is held by the electromagnet in a first operating position against a stator core of the actuator. By selectively de-energizing the electromagnet, the armature may begin movement towards a second operating position under the influence of a force exerted by the first return spring. Power to a coil of the actuator is then applied to move the armature across a gap and begin compressing the second return spring.

As can be appreciated by those skilled in the art, it is desirable to closely balance the spring force on the armature with the magnetic forces acting on the armature in the region near the stator core so as to achieve a near-zero velocity "soft landing" of the armature against the stator core. In order to obtain a soft-landing of the armature against the stator core, power may be removed from the coil as the armature approaches the stator in the second position. The stator coil may then be re-energized, just before landing the armature, to draw and hold the armature against the stator core. In practice, a soft landing may be difficult to achieve because the system is constantly being perturbed by transient variations in friction, supply voltage, exhaust back pressure, armature center point, valve lash, engine vibration, oil viscosity, tolerance stack up, temperature, etc.

Experimental results for particular engines and actuator arrangements indicate that to achieve quiet actuator operation and prevent excessive impact wear on the armature and stator core, the landing velocity of the armature should be less than 0.04 meters per second at 600 engine rpm and less than 0.4 meters per second 6,000 engine rpm. In order to achieve these results under non-ideal conditions (e.g., the harsh environment of an internal-combustion engine), it is necessary to dynamically adjust the magnetic flux generated within the stator core to compensate for variations in operating voltage, friction within the actuator, engine back-pressure and vibration, during every stroke of the armature. External sensors, such as Hall sensors, have been used to measure flux in electromagnetic actuators. However, sensors have proven to be too costly and cumbersome for practical applications.

Thus, a need exists for a sensorless control system and method for an electromagnetic actuator capable of dynamically compensating for non-ideal disturbances that exist in and near internal combustion engines. Further, a need exists for a high-speed sensorless control system and method for an electromagnetic actuator capable of detecting and compensating for the above-described non-ideal conditions during each stroke cycle of the armature.

SUMMARY OF THE INVENTION

A method is provided for controlling velocity of an armature in an electromagnetic actuator as the armature moves from a first position towards a second position. The electromagnetic actuator includes a coil and a core at the second position. The coil conducts a current and generates a magnetic force to cause the armature to move towards and land at the second position. A spring structure acts on the armature to bias the armature from the second position.

A magnetic flux is generated in the coil such that the flux increases linearly at a first rate. The first rate is proportional to a crossover time from a previous cycle. The current passing through the coil is sensed and a near peak value of current corresponding to the crossover time for the present cycle is detected. The rate of linear flux increase is changed from the first rate to a second rate at the crossover time. The second rate is proportional to the derivative of the current during the previous cycle evaluated at a gamma time from the previous cycle. The gamma time corresponds to the occurrence of a predetermined ratio between the current and the derivative of the current during a cycle. The flux is allowed to increase rapidly without constraint upon the occurrence of the predetermined ratio between the current and the derivative of the current so as to capture and hold the armature in the second position.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
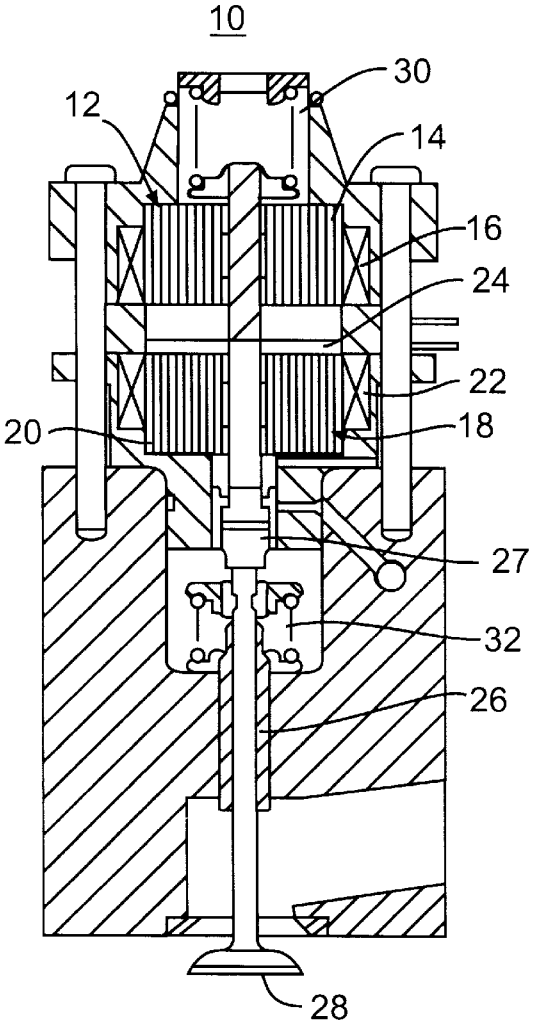
FIG. 1 illustrates a sectional view of an electromagnetic actuator provided in accordance with the principles of the present invention, shown in a valve open position.
Figure 2:
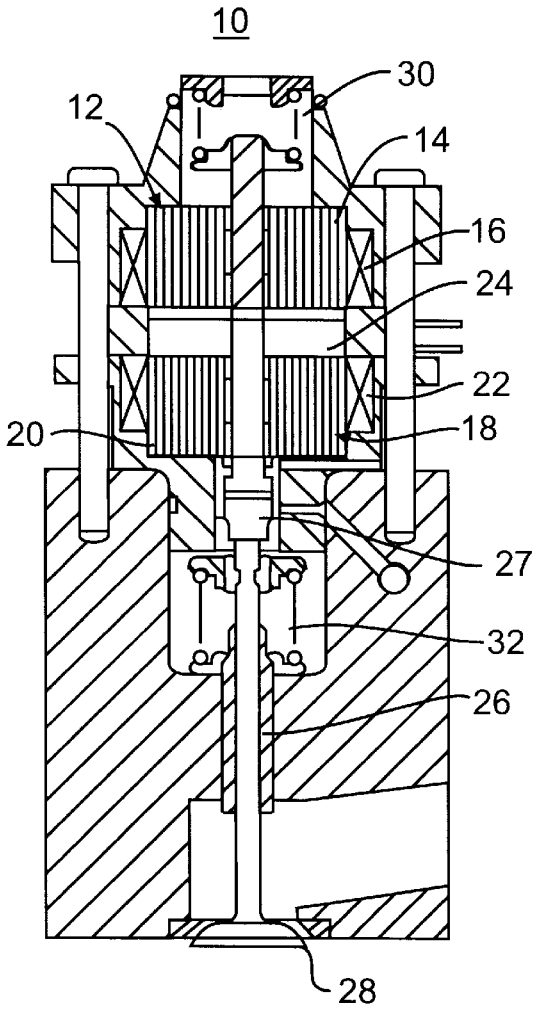
FIG. 2 illustrates a sectional view of an electromagnetic actuator provided in accordance with the principles of the present invention, shown in a valve closed position.

FIGS. 1 and 2 illustrate an electromagnetic actuator 10. The electromagnetic actuator 10 includes a first electromagnet 12 that includes a stator core 14 and a solenoid coil 16 associated with the stator core 14. A second electromagnet 18 is disposed in opposing relation to the first electromagnet 12. The second electromagnet includes a stator core 20 and a solenoid coil 22 associated with the stator core 20. The electromagnetic actuator 10 includes an armature 24 that is attached to a stem 26 of a cylinder valve 28 through a hydraulic valve adjuster 27. The armature 24 is disposed between the electromagnets 12 and 18 so as to be acted upon by the electromagnetic force created by the electromagnets. In a de-energized state of the electromagnets 12 and 18, the armature 24 is maintained in a neutrally-biased rest position between the two electromagnets 12 and 18 by opposing return springs 30 and 32. In a valve closed position (FIG. 2), the armature 24 engages the stator core 14 of the first electromagnet 12.

To initiate motion of the armature 24 and thus the valve 28 from the closed position into an open position (FIG. 1), a holding current through solenoid coil 16 of the first electromagnet 12 is removed. As a result, a holding force of the electromagnet 12 falls below the spring force of the return spring 30 and thus the armature 24 begins moving under the force exerted by return spring 30. It is necessary to build enough magnetic flux in the coil 22 so there will be sufficient magnetic force to make the armature 24 move from one stator 14 to another 18 while overcoming the opposing neutrally-biased return springs. To catch the armature 24 in the open position, a catch current is applied to the electromagnet 18. Once the armature has landed at the stator core 20, the catch current is changed to a hold current which is sufficient to hold the armature at the stator core 20 for a predetermined period of time. The rate of change of flux sensed is used as a feedback variable to control a landing velocity of an armature by controlling the catch current.

An example of using rate of change of flux as a feedback variable is taught in U.S. patent application Ser. No. 09/025,986, filed Feb. 19, 1998 and entitled "Electronically Controlling the Landing of an Armature in an Electromagnetic Actuator", the contents of which is hereby incorporated in its entirety into the present specification by reference.

An example of feedback control based on a rate of change of flux without the need for a flux sensor is disclosed in U.S. patent application Ser. No. 09/122,042, filed Jul. 24, 1998, now U.S. Pat. No. 5,991,143, and entitled "A Method for Controlling Velocity of an Armature of an Electromagnetic Actuator", the contents of which is hereby incorporated in its entirety into the present specification by reference.

According to a preferred embodiment of the present disclosure, a three-stage closed-loop compensation system is provided that successively refines the balance between the magnetic force generated by the magnetic flux in the system and the mechanical spring forces acting on the armature 24 to provide a soft landing of the armature against the stator core 14. Referring to FIGS. 3, 6, 7 and 8, the system provides three independent closed-loop means for controlling the slope of a linearly increasing magnetic flux in an electromagnetic actuator during successive stages of an armature stroke. Each of the compensation means, alpha slope compensation, beta slope compensation and gamma time compensation provide successively refined control over the flux generated by the coils 16 and 22 and the resulting magnetic force exerted on the armature 24. The purpose of each control means is to adjust the flux slope value at critical times during the armature stroke cycle to compensate for non-ideal system variables such as friction, exhaust back pressure, voltage fluctuations, and mechanical mid-position armature adjustment. Closed-loop compensation of the flux slope during the armature stroke ensures that the armature will continue to land softly even as non-ideal influences perturb the system.

The alpha flux slope is a first level global compensation that accounts for slow changes in the system, such as viscosity changes that occur in oil as engine temperature increases. The beta flux slope is second level compensation capable of more rapid change, for example, it will respond to load changes on an engine. The gamma turn-off time is a same-cycle adjustment that turns off the servo current control, allowing the coil current to build as rapidly as possible.

Figure 3:
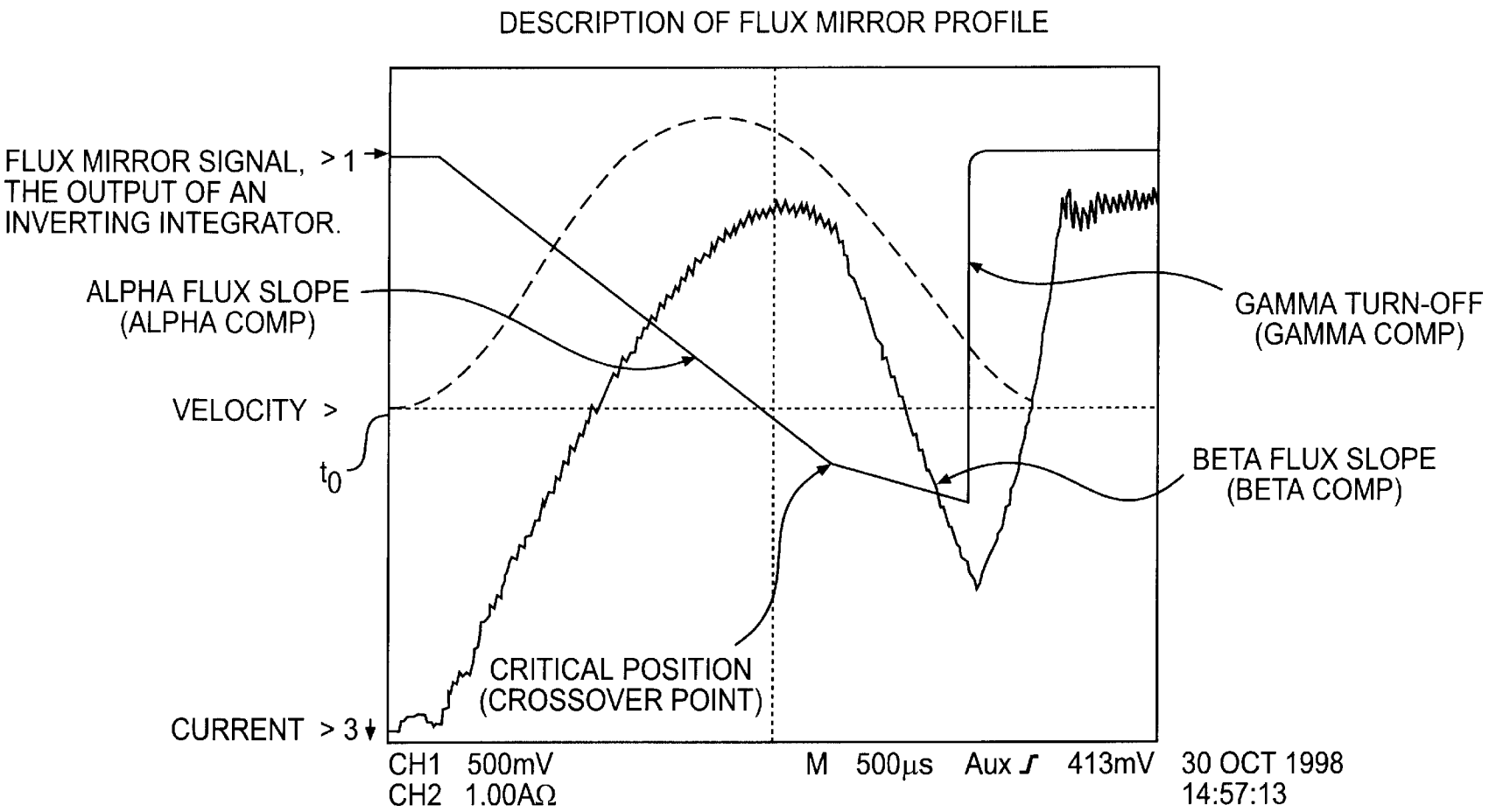
FIG. 3 illustrates the relationships between armature velocity, current through the coil, and magnetic flux during alpha slope compensation, beta slope compensation and gamma slope compensation for an entire armature stroke.

An entire armature cycle under closed-loop flux control will now be described. With reference to FIGS. 1–3, the armature 24 begins movement at to as the current through the coil holding the armature is turned off and the armature moves under the influence of the force exerted by a return spring 30. At approximately the same time, current is energized in an attracting coil 22 such that a constantly linearly increasing flux begins building in the coil under control of the alpha compensation closed-loop circuit. Under alpha-slope control, energy is placed into the system so that the nominal energy value may be sufficient for successive closed-loop control methods to refine and fine-tune the forces acting on the armature so as to obtain an optimal landing and capture of the armature. During the alpha slope period, the slope alpha of the linear flux curve is proportional to the time that the crossover from alpha compensation to beta compensation occurred during the previous cycle. During alpha compensation, the flux increases linearly at a constant rate while the current is observed. As the flux in the coil builds linearly under alpha slope flux control, the current is observed until a peak current is detected by sensing a 5–10% drop in current from a maximum value. This point is called the critical position and corresponds to when the system changes from alpha slope compensation to beta slope compensation.

During the beta slope compensation period, the slope of the linear flux curve, beta, is proportional to the derivative of the current through the coil evaluated at the end of the beta compensation control period during the previous cycle. The end of the beta compensation control period for each cycle corresponds to the gamma time. Thus, during beta slope compensation, the slope of the linear flux curve corresponds to the derivative of the current through the coil evaluated at the gamma time of the previous cycle. During the beta slope compensation period, the current level and its derivative are observed. Current decreases under beta slope control primarily due to the increase in inductance of the coil. The inductance of the coil increases due to the decrease in the air gap. As the air gap decreases, the sensitivity of the system to changes in armature position increases.

When the current level and its derivative reach an experimentally predetermined ratio, corresponding to a particular position and velocity relationship, the beta slope control is removed and the current is allowed to build as rapidly as possible to capture the armature in a rest position proximate, and preferably on, the opposite pole piece. The threshold ratio of current and derivative of current is based on the value of the current derivative evaluated at the end of the beta slope time of the previous cycle (the gamma turn off time).

Under flux control, current through the coil is proportional to the position of the armature as can be understood from the following derivation:

Given: R=reluctance of the coil; $\Phi$=magnetic flux through the coil; N=turns of the coil; I=current through the coil;

$\lambda$=coil gap; $\mu$=permeability of SiFe; the basic static relationship: $R\Phi=NI$; and the constraint that $\Phi(t)=\Phi_0 t$ (a ramp function); it can be shown that: I is proportional to $\lambda t/\mu[\Phi(\lambda,t)]$. When the coil is not near magnetic saturation, the denominator term, $\mu[\Phi(\lambda,t)]$, is linear enough to estimate the gap from the magnitude of I. It also follows that velocity can be estimated from the derivative of I.

Figure 4:
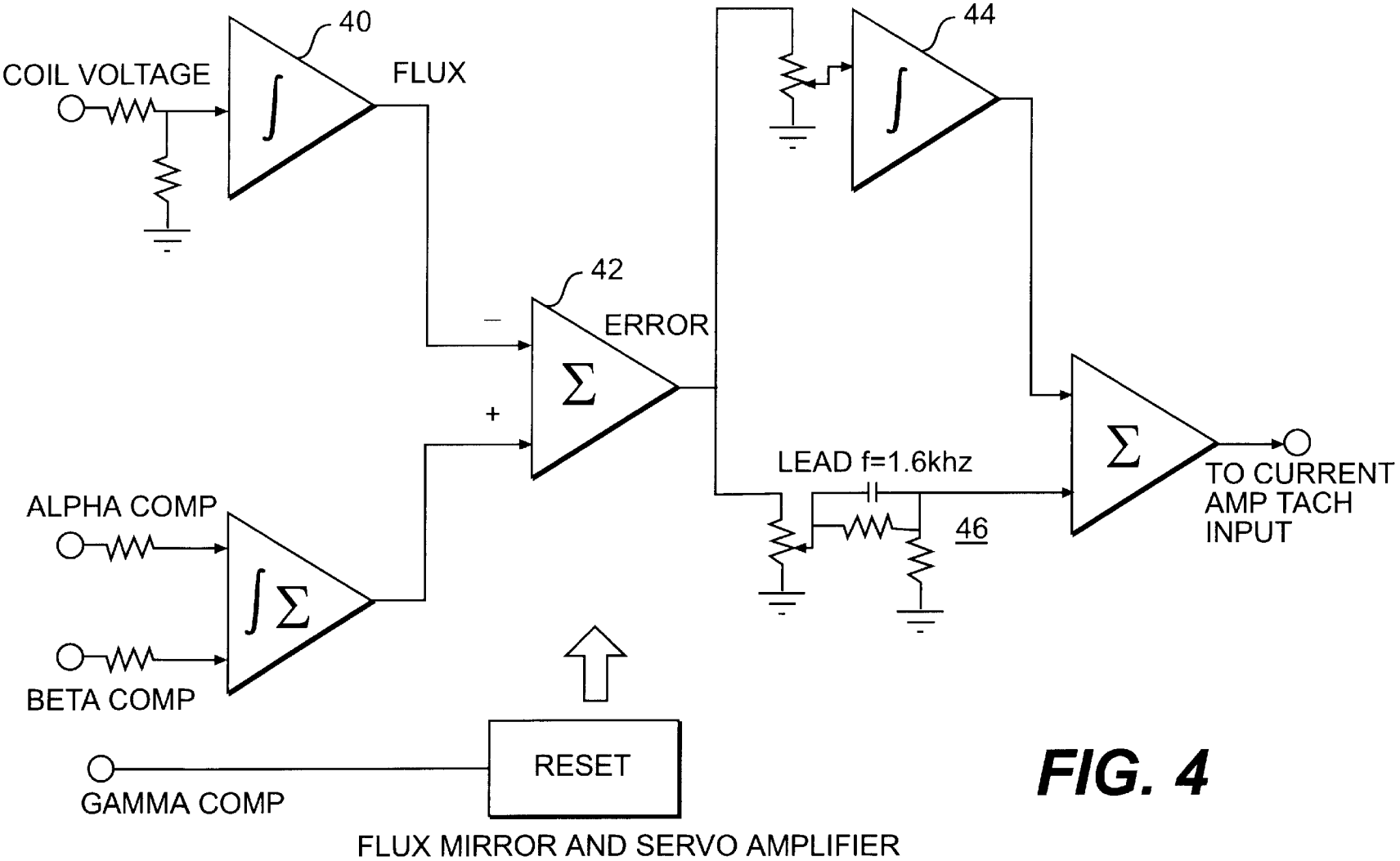
FIG. 4 is a block diagram illustrating the flux mirror and servo amplifier according to a preferred embodiment of the present invention.

Referring now to FIG. 4, the input to the flux mirror 40 comes from observing the coil voltage. The coil voltage is fed into an integrator that determines flux using a flux mirror circuit as disclosed in the above-referenced and incorporated U.S. patent application Ser. No. 09/122,042, entitled "A Method for Controlling Velocity of an Armature of an Electromagnetic Actuator." The flux output, as determined from the coil voltage input, is the feedback signal to an error amplifier summing junction 42. The command signals are the alpha compensation and the beta compensation inputs that are summed, integrated and fed into the non-inverting input of the summing junction 42. The alpha and beta comparator inputs represent the desired signal while the flux input represents the actual flux signal generated. The error corresponds to the error characteristic of known PID type control systems. The integral block 44 is the I term, the RC diagram 46 represent the proportional and derivative terms. The error is summed and fed to the current amplifier and is used to drive the error difference between the actual flux and desired flux toward zero on each successive armature stroke. Upon reaching the gamma time, the system is reset and the contents of the integrators in the circuit are cleared in preparation for a new cycle.

The critical position for cross-over from alpha flux slope compensation control to beta flux slope compensation control is determined by controlling the current, by servo control of a current source, such that the flux through the coil increases in a linear fashion. Armature position can be inferred from the profile of the current waveform that generates a linearly increasing flux in the coil. The critical cross-over position occurs in the vicinity of the peak current through the coil, given linearly increasing flux. Once the critical position is reached, the system recognizes that the armature 24 is moving very close to the stator 20 with a known momentum. At the critical point, the flux goes under beta slope flux control and the armature 24 begins to slow down in preparation for landing. The transfer from alpha slope flux control to beta slope flux control is necessary because if the current was allowed to continue to build linearly under alpha slope flux control, the armature could land hard against the opposing stator and a soft landing would not be achieved.

Formally, the critical position can be derived as follows:

Given: $\Phi$ is a function of current and inductance, $\Phi(I,L)$, the rate of change of $\Phi$ is given by the expression $d\Phi/dt=IdL/dt+LdI/dt$; at the critical position, $dI/dt=0$, so $d\Phi/dt=IdL/dt$; and $d\Phi=IdL$; that is to say the rate of change of flux equals the rate of change of inductance scaled by current. Furthermore, when $d\Phi$=constant (a ramp), $K=IdL$ and $dL=I/K$. This particular change of inductance can only occur at one unique air gap in the actuator corresponding to the critical position.

Figure 5:
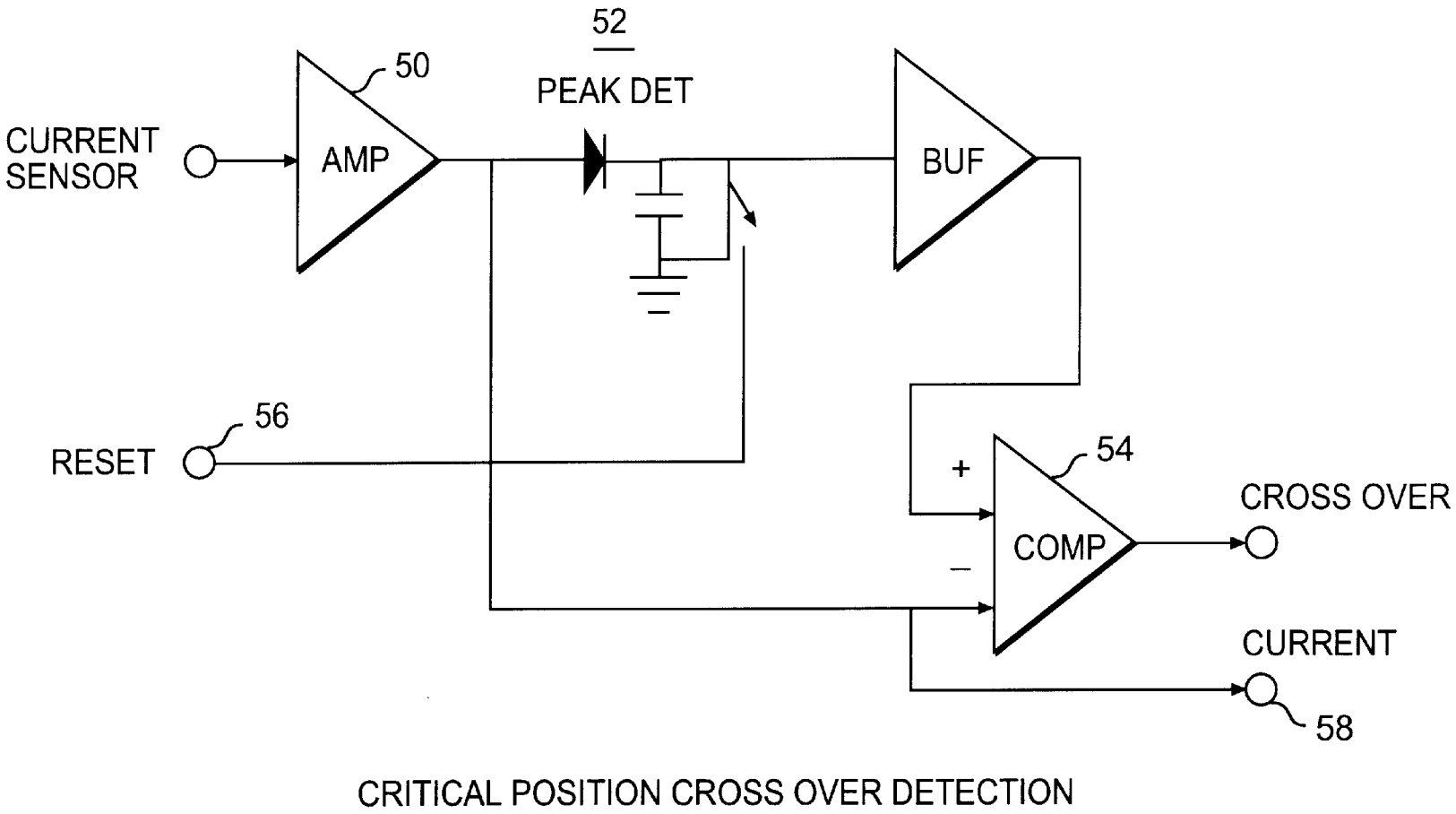
FIG. 5 is a block diagram illustrating the critical position and cross-over detection according to a preferred embodiment of the present invention.
Figure 6:
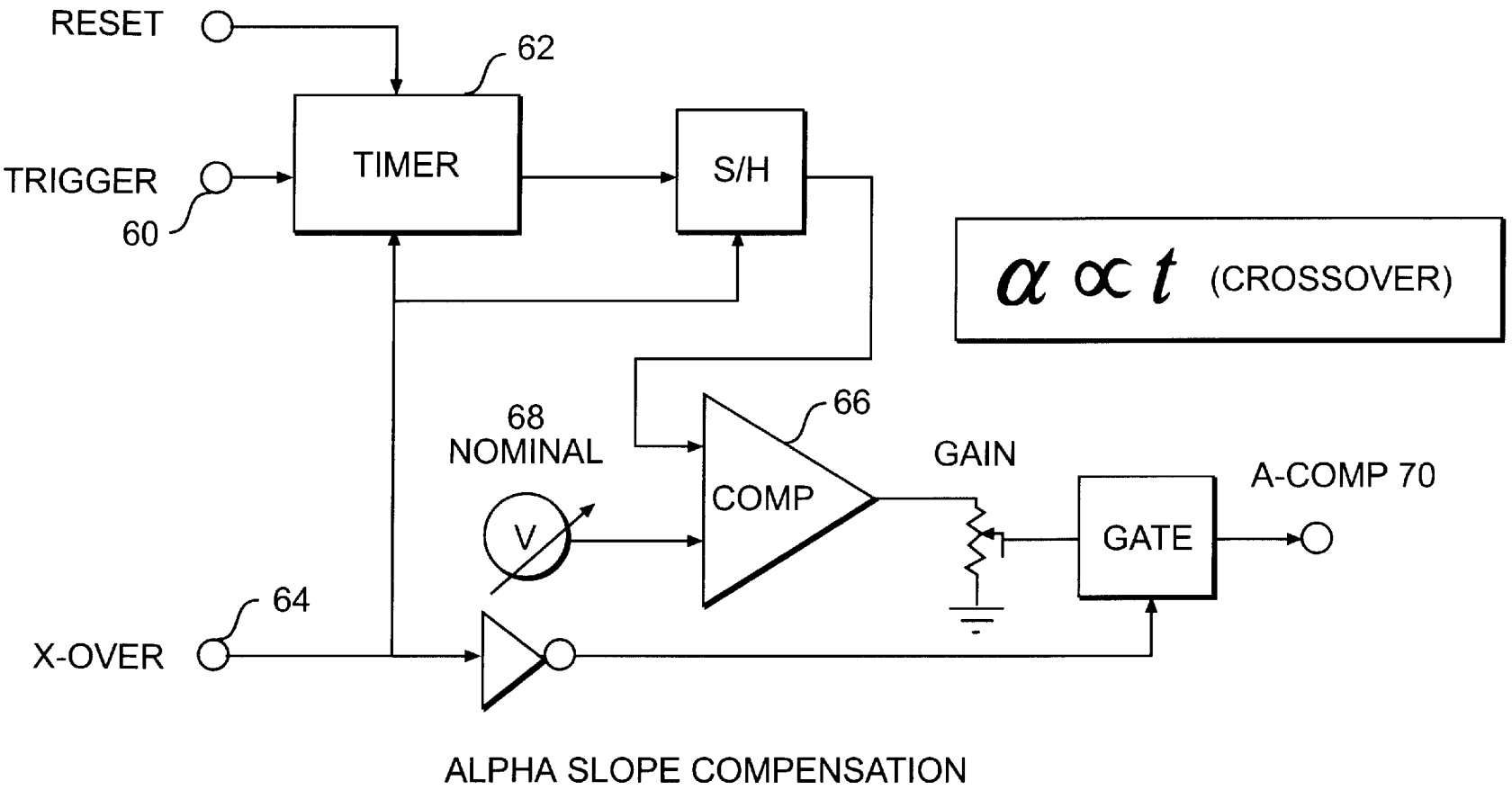
FIG. 6 is a block diagram illustrating alpha slope compensation detection according to a preferred embodiment of the present invention.

Referring now to FIG. 5, the critical position for cross-over from alpha flux slope compensation control to beta flux slope compensation control is determined according to a preferred embodiment as follows. The cross-over point is determined from the current profile. The current is input into an amplifier 50. The output of the amplifier feeds into a circuit 52 that detects the approximate current peak. The approximate current peak is innovatively detected by monitoring the current and detecting a 5–10% decrease from a maximum value. The peak current value becomes an input to a comparator circuit 54. When the current drops below its peak value, the output of the comparator goes high (to logic 1), which indicates that the crossover point has been reached. The reset line 56 is triggered at cross-over to reset the critical position cross-over detector for the next cycle. The current output 58 shown in FIG. 6 is used elsewhere, for example as the current input for the beta or gamma compensation.

The phenomena of the current turning downward, as shown in FIG. 3, would not occur if the flux through the coil was not forced to increase in a constant linear fashion under servo control. The turn-down current phenomenon appears to be unique to the current profile through a coil when a armature is moving under the influence of a linearly increasing flux generated by the coil. Thus, it is believed that the key to detecting the critical cross-over point corresponding; to the peak current is building the flux in a linear fashion while the armature is moving and closing the air gap. If the armature is not moving, the flux will continue to increase and the current will also increase until a saturation level is reached.

Accordingly, in an alternative preferred embodiment, the above-described critical position detection method may be used alone to determine whether an electromagnetic actuator has completed a cycle or if the armature 24 has become stuck in mid-stroke. If the armature has completed its cycle properly under the influence of a linearly increasing flux, then the current profile through the coil 22 will exhibit the characteristic peak turn-down described above. However, if the armature has become stuck in mid-stroke, the current profile will not exhibit the turn-down characteristic.

The alpha slope compensation closed-loop control system will now be described. The critical relationship that governs alpha slope compensation is that the slope of the magnetic flux characteristic through the coil during alpha slope control is proportional to the time at which the crossover occurred during the previous cycle.

The alpha slope may be determined by comparing when the critical position occurs in time with an experimentally determined nominal value. If the critical position occurs earlier than the nominal time, the armature is moving too rapidly and the alpha flux slope is decreased for the next cycle. Conversely, if the critical position occurs later than the nominal time, the armature is moving too slowly and the alpha flux slope is increased for the next cycle. The critical position occurs only at one unique armature/stator gap that is determined by the mechanical configuration of the actuator. The alpha flux slope compensation is a correction that is applied to succeeding cycles. It does not correct armature velocity during the cycle in which the alpha slope is determined.

FIG. 6 depicts alpha slope compensation according to a preferred embodiment. The trigger input signal 60 starts the timer 62 from time zero. The crossover logic input 64 is fed by the output of the crossover detection section described above. The comparator 66 compares a nominal reference time 68 with the actual time crossover occurred during the previous cycle. If the time it takes to get to crossover is greater than or less than the nominal time, the control system outputs an alpha compensation control signal 70. The alpha control signal has the effect of increasing the alpha slope if the previous cycle time to crossover was too long and decreasing the alpha slope if the previous cycle time to crossover was too short.

The beta slope compensation closed-loop control system will now be described. The critical relationship that governs beta slope compensation is that the beta slope is proportional to the derivative of the current evaluated at the gamma time of the previous cycle.

The beta flux compensation slope for each succeeding cycle is set based on the derivative of the current evaluated at the gamma turn-off time. If the derivative of the current at the gamma turn-off time is greater than a nominal, experimentally determined value, the armature was moving too fast, indicating that the beta flux slope should be decreased so as to put less energy into the system during the next cycle. Conversely, if the derivative of the current at the gamma turn-off time is lower than a nominal value, the armature was moving too slow, indicating that the beta flux slope should be increased to put more energy into the system for the next cycle.

Figure 7:
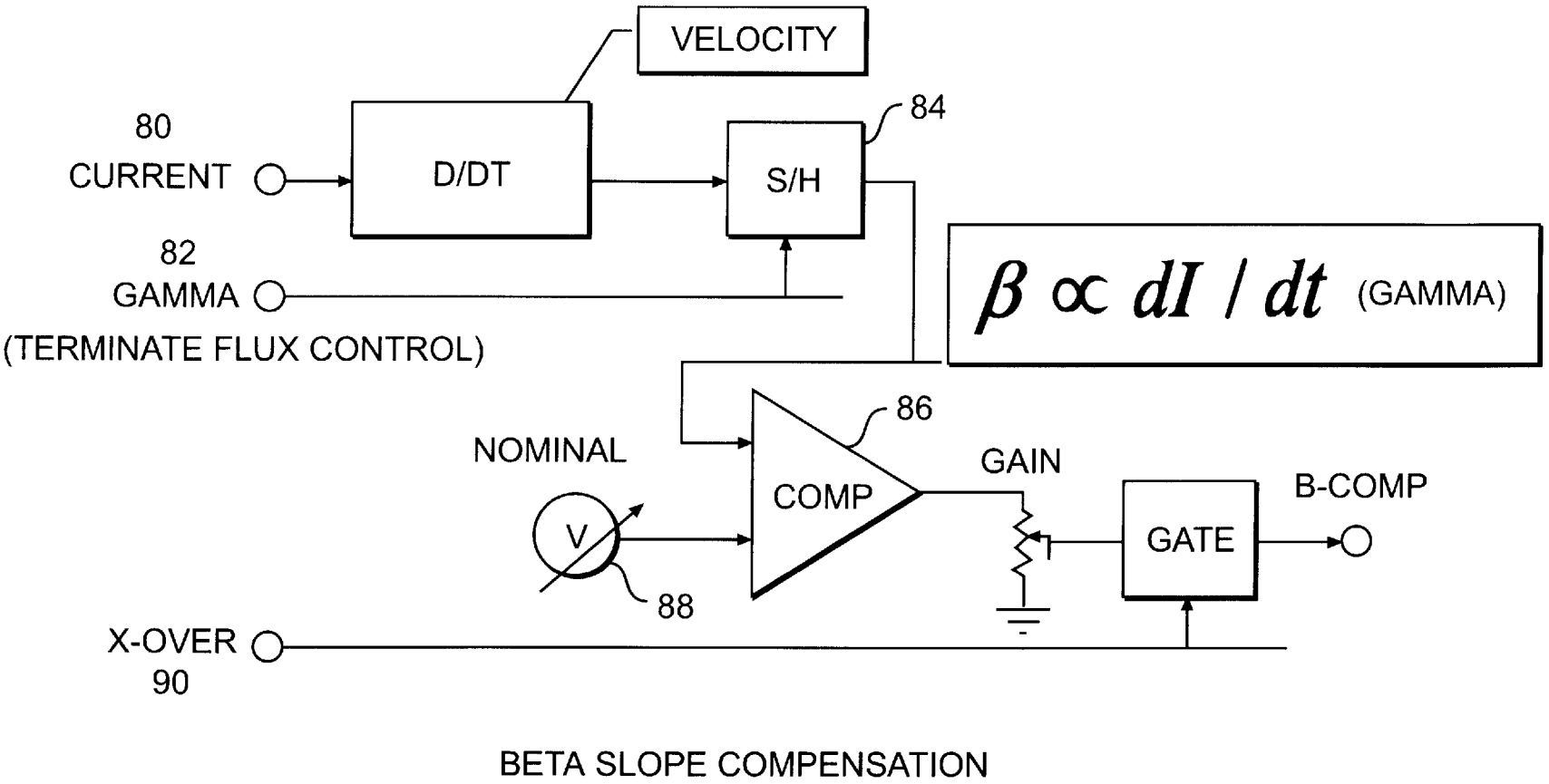
FIG. 7 is a block diagram illustrating beta slope compensation detection according to a preferred embodiment of the present invention.

FIG. 7 depicts beta slope compensation according to a preferred embodiment. The current 80 is input and its derivative is taken. In the beta-slope region of the flux profile, the derivative of the current is proportional to the velocity. In order to obtain the derivative of the current evaluated at the gamma time for the next cycle, we sample and hold the derivative at the gamma time. Gamma 82 is a triggering input to the sample and hold 84. The output of the sample and hold 84 that feeds into the comparator 86 is the derivative of the current at the gamma time. It is compared against a nominal value 88, which is adjusted manually. The output of the comparator 86 is then scaled to the desired gain. It is then gated and controlled by the cross-over detector output 90 for use in setting the beta slope during the next cycle.

Figure 8:
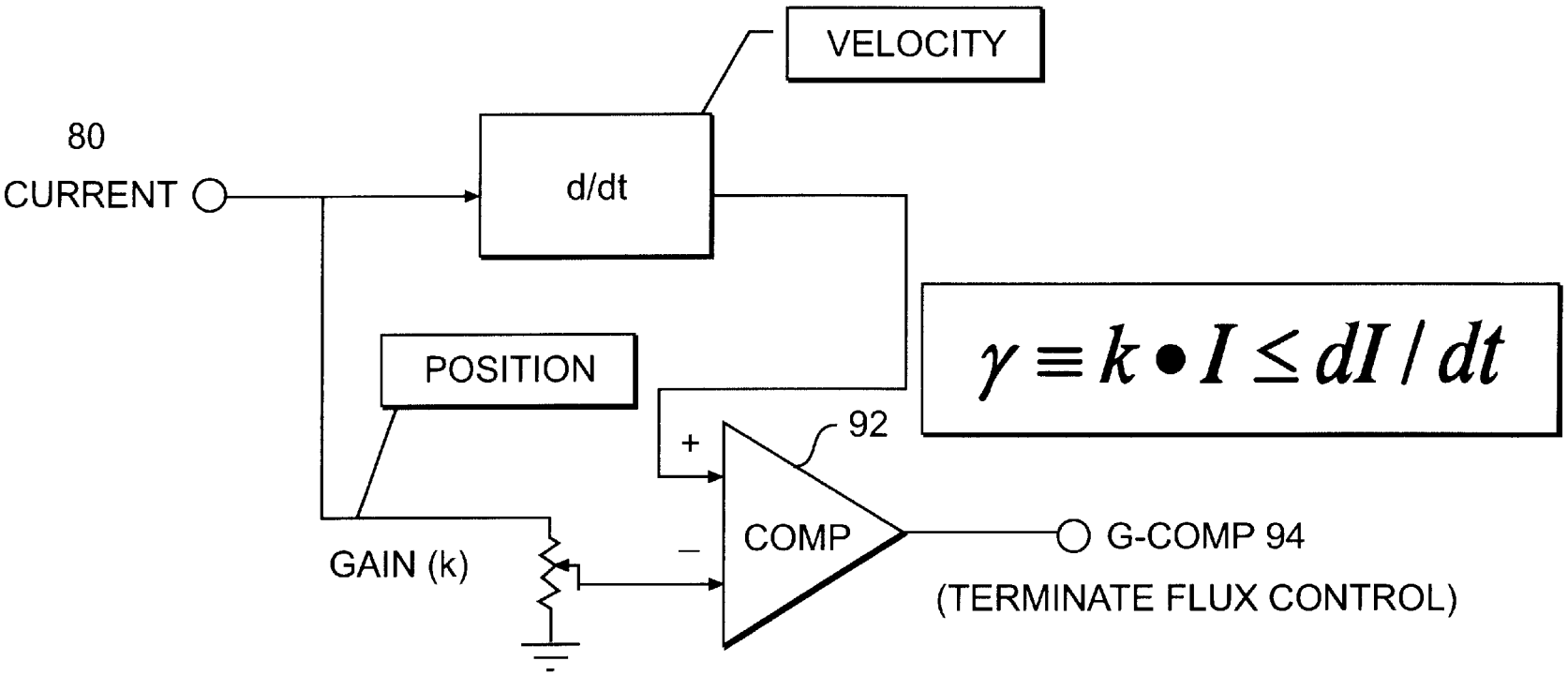
FIG. 8 is a block diagram illustrating gamma time compensation detection according to a preferred embodiment of the present invention.

The gamma time compensation closed-loop control system will now be described. The critical relationship that governs gamma time compensation is that the gamma time is equal, by definition, to proportionality constant k times the current, which must be less than or equal to the derivative of the current. Thus, k represents a particular ratio between the current through the coil and its derivative. FIG. 8 depicts gamma time compensation according to a preferred embodiment. The current 80 is input and its derivative is taken. The derivative of the current is proportional to velocity, while the current itself is proportional to position. The gain potentiometer determines the proportionality constant k. The comparator 92 effectively takes tile ratio of the position, fed into the inverting input, and the velocity that is fed into the non-inverting input. The output of the comparator 92 is the gamma compensation 94 and corresponds to the time when the system terminates flux control and allows the current to build in the coil as rapidly as possible so that the armature will be firmly captured against the new stator. The gain k is initially set by observing the velocity and position in real-time and adjusting the gain until a soft landing is achieved.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but have the full scope defined by the language of the following claims, and equivalents thereof.

What We claim is:

1. A method of controlling velocity of an armature in an electromagnetic actuator as the armature moves from a first position towards a second position, the electromagnetic actuator including a coil and a core at the second position, the coil conducting a current and generating a magnetic force to cause the armature to move towards and land at the second position, and a spring structure acting on the armature to bias the armature from the second position, the method comprising the steps of:

generating magnetic flux in the coil such that the flux increases linearly at a first rate, the first rate being proportional to a crossover time from a previous cycle;

sensing the current passing through the coil;

detecting a near peak value of the current corresponding to the crossover time for the present cycle;

changing the rate of linear flux increase from the first rate to a second rate at the crossover time, the second rate being proportional to the derivative of the current during the previous cycle evaluated at a gamma time from the previous cycle, and the gamma time corresponding to the occurrence of a predetermined ratio between the current and the derivative of the current during a cycle; and sensing the current and the derivative of the current and allowing the flux to increase rapidly without constraint upon the occurrence of the predetermined ratio between the current and the derivative of the current so as to capture and hold the armature in the second position.

2. The method of controlling velocity of an armature in an electromagnetic actuator according to claim 1, wherein the step of generating magnetic flux in the coil further includes the step of placing a current generator under servo control to generate the linearly increasing flux in the coil.

3. The method of controlling velocity of an armature in an electromagnetic actuator according to claim 1, wherein the first rate, the second rate and the gamma time are dynamically optimized to provide a near zero velocity landing of the armature in the second position.

4. The method of controlling velocity of an armature in an electromagnetic actuator according to claim 3, wherein the step of detecting a near peak value of the current corresponding to the crossover time for the present cycle further includes the step of sensing a predetermined decrease in current from a maximum value.

5. The method of controlling velocity of an armature in an electromagnetic actuator according to claim 4, wherein the dynamic optimization of the first rate, the second rate and the gamma time compensates for variations in supply voltage, mechanical vibration, temperature changes, changing friction, exhaust back pressure, armature center variation, or positive valve lash to maintain a near zero velocity armature landing speed.

6. The method of controlling velocity of an armature in an electromagnetic actuator according to claim 5, wherein the dynamic optimization of the first rate, the second rate and the gamma time ensures an armature landing velocity of less than 0.04 meters per second at 600 engine RPM and less than 0.4 meters per second at 6000 engine RPM.

7. The method of controlling velocity of an armature in an electromagnetic actuator according to claim 1, further including the steps of comparing the crossover time with a first nominal value and adjusting the first rate to decrease the difference between the crossover time and the first nominal value during the next armature cycle.

8. The method of controlling velocity of an armature in an electromagnetic actuator according to claim 7, further including the steps of comparing the derivative of the current at the gamma time with a second nominal value and adjusting the second rate to decrease the difference between the derivative of the current and the second nominal value during the next armature cycle.

9. The method of controlling velocity of an armature in an electromagnetic actuator according to claim 8, further including the step of dynamically optimizing the predetermined ratio between the current and the derivative of the current during every armature stroke such that an armature landing velocity of less than 0.04 meters per second at 600 engine RPM and less than 0.4 meters per second at 6000 engine RPM is achieved.

10. A method of determining if an armature in an electromagnetic actuator is moving properly as the armature moves from a first position towards a second position, the electromagnetic actuator including a coil and a core at the second position, the coil conducting a current and generating a magnetic force to cause the armature to move towards and land at the second position, and a spring structure acting on the armature to bias the armature from the second position, the method comprising the steps of:

generating magnetic flux in the coil such that the flux increases linearly at a first rate, wherein the first rate is proportional to a crossover time from a previous cycle;

sensing the current passing through the coil;

searching for a peak value in the current waveform;

concluding the armature is not moving if no peak value in the current waveform is detected.

11. An apparatus for controlling velocity of an armature in an electromagnetic actuator as the armature moves from a first position towards a second position, the electromagnetic actuator including a coil and a core at the second position, the coil conducting a current and generating a magnetic force to cause the armature to move towards and land at the second position, and a spring structure acting on the armature to bias the armature from the second position, the apparatus comprising:

a means for generating magnetic flux in the coil such that the flux increases linearly at a first rate, wherein the first rate is proportional to a crossover time from a previous cycle;

a means for sensing the current passing through the coil;

a means for detecting a near peak value of the current corresponding to the crossover time for the present cycle;

a means for changing the rate of linear flux increase from the first rate to a second rate at the crossover time, wherein the second rate is proportional to the derivative of the current during the previous cycle evaluated at a gamma time from the previous cycle, and wherein the gamma time corresponds to the occurrence of a predetermined ratio between the current and the derivative of the current during a cycle; and a means for sensing the current and the derivative of the current and allowing the flux to increase rapidly without constraint upon the occurrence of the predetermined ratio between the current and the derivative of the current so as to capture and hold the armature in the second position.

12. The apparatus for controlling velocity of an armature in an electromagnetic actuator according to claim 11 wherein a current generating means under control of a servo means generates the current to produce a linearly increasing flux in the coil.

* * * * *